US006139382A

United States Patent [19]

Eschbacher et al.

[11] Patent Number: 6,139,382

[45] Date of Patent: Oct. 31, 2000

[54] FLOTATION UNIT FOR SWIMMING POOLS

[76] Inventors: Vincent H. Eschbacher, 125 Staehle Ct.; Tony Jost, Jr., 2718 Cliffwood Trail, both of St. Louis, Mo. 63129

[21] Appl. No.: 09/295,349

[22] Filed: Apr. 21, 1999

[51] Int. Cl.[7] ..... B63B 22/24; B63B 35/85; B63B 5/24

[52] U.S. Cl. ..... 441/32; 441/136; 114/357

[58] Field of Search ..... 114/264, 256, 114/357; 441/32, 136, 40

[56] References Cited

U.S. PATENT DOCUMENTS

| | | | |
|---|---|---|---|
| 3,802,007 | 4/1974 | Dolan, Jr. | 9/8 R |
| 3,831,209 | 8/1974 | Clingman | 9/1 A |
| 4,206,565 | 6/1980 | Golfgarb | 46/41 |
| 4,683,900 | 8/1987 | Carmichael . | |
| 4,766,918 | 8/1988 | Odekirk . | |
| 4,828,520 | 5/1989 | Baughman et al. . | |
| 5,116,275 | 5/1992 | Sassak | 446/48 |
| 5,162,007 | 11/1992 | Leslie | 441/129 |
| 5,235,774 | 8/1993 | Burghoff | 43/17.1 |
| 5,299,588 | 4/1994 | Mac Leod . | |
| 5,394,822 | 3/1995 | Worland . | |
| 5,447,764 | 9/1995 | Langford | 428/36.9 |
| 5,476,404 | 12/1995 | Price | 446/221 |
| 5,505,645 | 4/1996 | Engler, Jr. . | |
| 5,518,431 | 5/1996 | Staley | 441/130 |
| 5,769,022 | 6/1998 | Luxford . | |
| 5,816,663 | 10/1998 | Steinle | 297/488 |

*Primary Examiner*—Mark T. Le
*Assistant Examiner*—Patrick Craig Muldoon
*Attorney, Agent, or Firm*—Oliff & Berridge, PLC

[57] ABSTRACT

A flotation unit, for example a table, for use within water such as a swimming pool has a sufficient size and weight to be self-stable without requiring any external stabilization such as weights or extensions. The flotation unit may have an upper portion having one or more holding spaces therein and a lower portion that is substantially solid. The flotation unit may alternatively have a hollow interior. The flotation unit may include a sunshade, cup holders or electronic equipment within the holding spaces. The flotation unit is readily carried and transported.

17 Claims, 4 Drawing Sheets

FLOTATION UNIT FOR SWIMMING POOLS

BACKGROUND OF THE INVENTION

1. Field of the Invention

This invention relates to a flotation unit for recreational use in water, particularly in swimming pools. More in particular, the invention relates to a self-stabilized flotation table with functional holding spaces that is sturdy yet light in weight.

2. Discussion of Related Art

Several types of floating devices for recreational use in water are known. For example, U.S. Pat. No. 5,769,022 (Luxford) describes a float tube with a canopy. U.S. Pat. No. 5,394,822 (Worland) describes an umbrella support for an inner tube or raft type floating device. U.S. Pat. No. 4,828,520 (Baughman et al.) describes a modular liferaft that includes a canopy and support. U.S. Pat. No. 4,766,918 (Odekirk) describes a tent-type apparatus with an inflatable frame for use upon water. U.S. Pat. No. 4,683,900 (Carmichael) describes a canopy and attachment for use with boats, tractors and the like.

For use within swimming pools, U.S. Pat. No. 5,299,588 (MacLeod) describes a floatable sunshade assembly comprising an umbrella sunshade and a floatable support or platform. The floatable support may serve as a refreshment stand or a convenient storage facility. For use within swimming pools, it is described in the paragraph bridging columns 4 and 5 of the patent that a weight 46 and outriggers 40 connected to the support member by radial stringers 42 should be employed in order to maintain the stability of the support member. This configuration is illustrated in FIGS. 8 and 9 in the patent.

U.S. Pat. No. 5,505,645 (Engler, Jr.) describes a floatable assembly for swimming pools comprised of a rigid pole supporting a sunshade and a float table that the pole extends through. The float table floats on the water. The pole extends through the float table to well below the water depth, preferably contacting the bottom of the pool in deep water, and has a weight connected to the lower end of the pole for stability of the assembly.

The problem with known swimming pool floating units such as described in the patents discussed above is that they are bulky and they require impractical and cumbersome external stabilization, such as with weights as in Engler, Jr. or extensions and weights as in MacLeod, in order to provide the unit with the stabilization required for practical use within a swimming pool. Moreover, prior floatable units such as discussed above require difficult attachments for sunshades and/or umbrellas, making it difficult to travel easily with the unit as a result of the size of the unit or the work required to assemble and disassemble the unit.

SUMMARY OF THE INVENTION

What is sought is a flotation unit that is self-stable and does not require external stabilization. What is also sought is a flotation unit in which a sunshade such as an umbrella can be readily attached and detached with minimal effort and in which the addition of the sunshade does not affect the stability of the flotation unit.

These and other objects are achieved by the invention that provides a self-stable flotation unit that is of a sufficient size, shape and weight for stability but still of a light weight so as to be easily carried by one individual.

In a first embodiment, the flotation unit of the invention has a design facilitating the self-stability of the unit in that the unit includes an upper portion containing the desired functional holding spaces and a lower portion that is substantially solid.

In a second embodiment, the flotation unit of the invention also has a design that facilitates the self-stability of the unit in that it is hollow so as to hold air therein but not hold water therein.

The flotation unit is comprised of materials that are lightweight and that do not absorb or retain water, which material further contributes to the self-stability of the flotation unit.

These and other objects are also achieved by the flotation unit of the invention in that the unit can include a functional holding space in the center of the top of the unit, which functional holding space accommodates a base for holding a sunshade, in particular an umbrella. The base can be formed into, fitted into or removably attached to the unit. The base is designed to receive an umbrella of various sizes. In this manner, assembly and disassembly of the sunshade to the unit is easily achieved so that the unit may be easily and conveniently transported.

BRIEF DESCRIPTION OF THE DRAWINGS

FIG. 1A illustrates an isometric view of the flotation unit of the invention without a unshade attached, while

DETAILED DESCRIPTION OF PREFERRED EMBODIMENTS

Figure 1A:
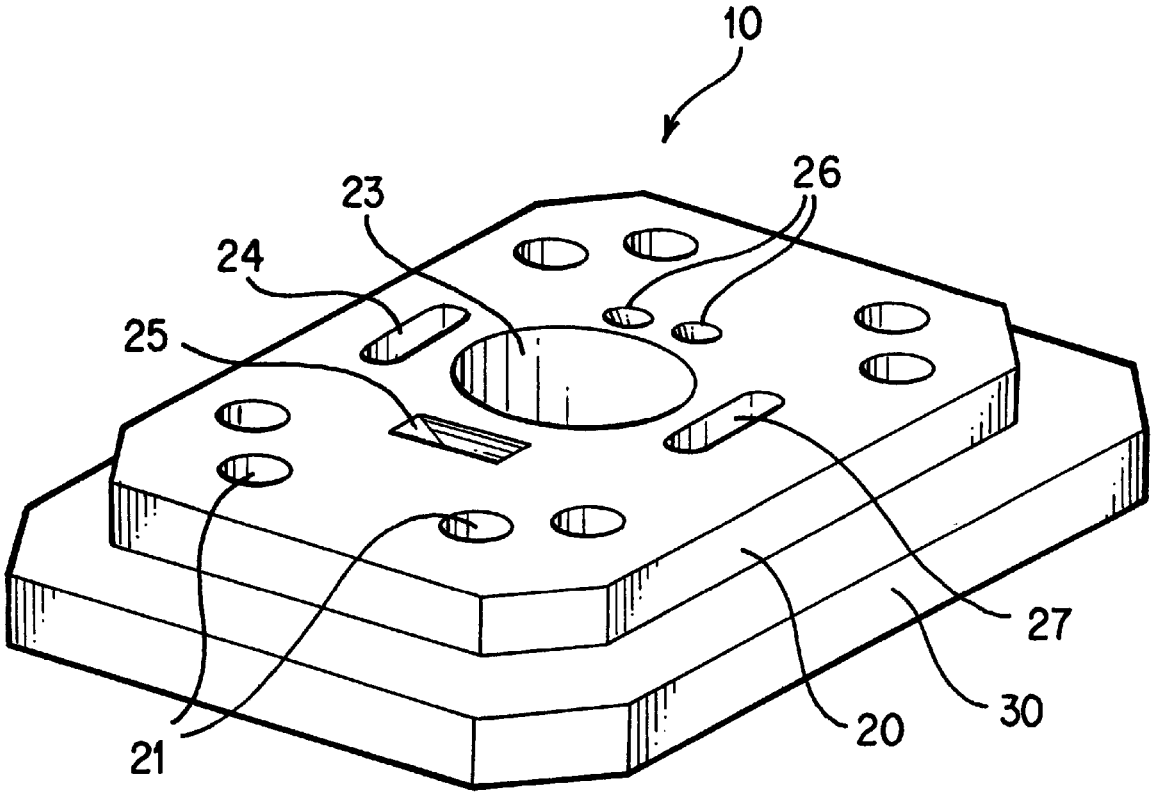

By "self-stable" as used herein is meant that the unit itself is stable in the water of a swimming pool so as not to tip over, or even tilt over to any substantial degree, regardless of the forces acting upon the flotation unit, and the unit does not require any external stabilization features such as weights or floating extensions for stability. The self-stabilization of the flotation unit of the invention is believed to be due to the dimensional size and design of the unit, as well as the materials used to make the unit, in combination. The self-stabilization is maintained regardless of the overall weight placed upon the unit, regardless of the presence or absence of a sunshade such as an umbrella, and regardless of the turbulence of the water within the pool.

The flotation unit, preferably a flotation table, may be made of any suitable lightweight moldable or formable material. Preferably, the material is such that it is not degraded by water and does not absorb or retain water. Thus, any polymeric plastic, for example polyethylene, polypropylene, polystyrene, etc., or foam, for example Styrofoam, may suitably be used. Most preferably, in the first embodiment described above, the flotation unit is comprised of Ethafoam, a polyethylene foam product of the Dow Chemical Company. Ethafoam is a dense but lightweight foam that can be easily cut in order to form the flotation unit of the invention. It can be obtained in 3 inch thick sheets ideal for forming the flotation unit of the invention. Also most preferably, in the second embodiment described above, the flotation unit is comprised of a high density polymer, for example a high density polyethylene, that can be readily formed into the hollow flotation unit, for example by injection blow molding and the like.

The material used can be of any color, the color being added to the unit in any known manner, including either before of after the unit is formed from the material. Thus, the unit may be painted following formation, or the material to be formed into the unit may be colored, for example by adding pigments to the material, prior to formation of the unit.

The flotation unit preferably has a size between a minimum size under which the unit becomes unstable and a maximum size over which the unit becomes too large for easy transport and/or use in a swimming pool. Suitable size ranges may vary depending upon the type of material used to construct the unit. For example, denser, heavier materials should desirably be kept towards a minimum size in order to maintain the easy transportability of the unit. When using Ethafoam, the flotation unit preferably has, for example, a width between 2 to 4 feet, most preferably between 3 to 4 feet, a length between 2 and 6 feet, most preferably between 4 to 5 feet, and a height between 2 to 12 inches, most preferably between 3 to 6 inches.

The flotation unit preferably has a weight that is both light weight and contributes to the self-stability of the unit. Light weight is desired for ease in maneuvering the unit and moving the unit in and out of the water. Preferably, the unit has an overall weight between 10 and 30 pounds, most preferably between 10 and 25 pounds.

Figure 3:
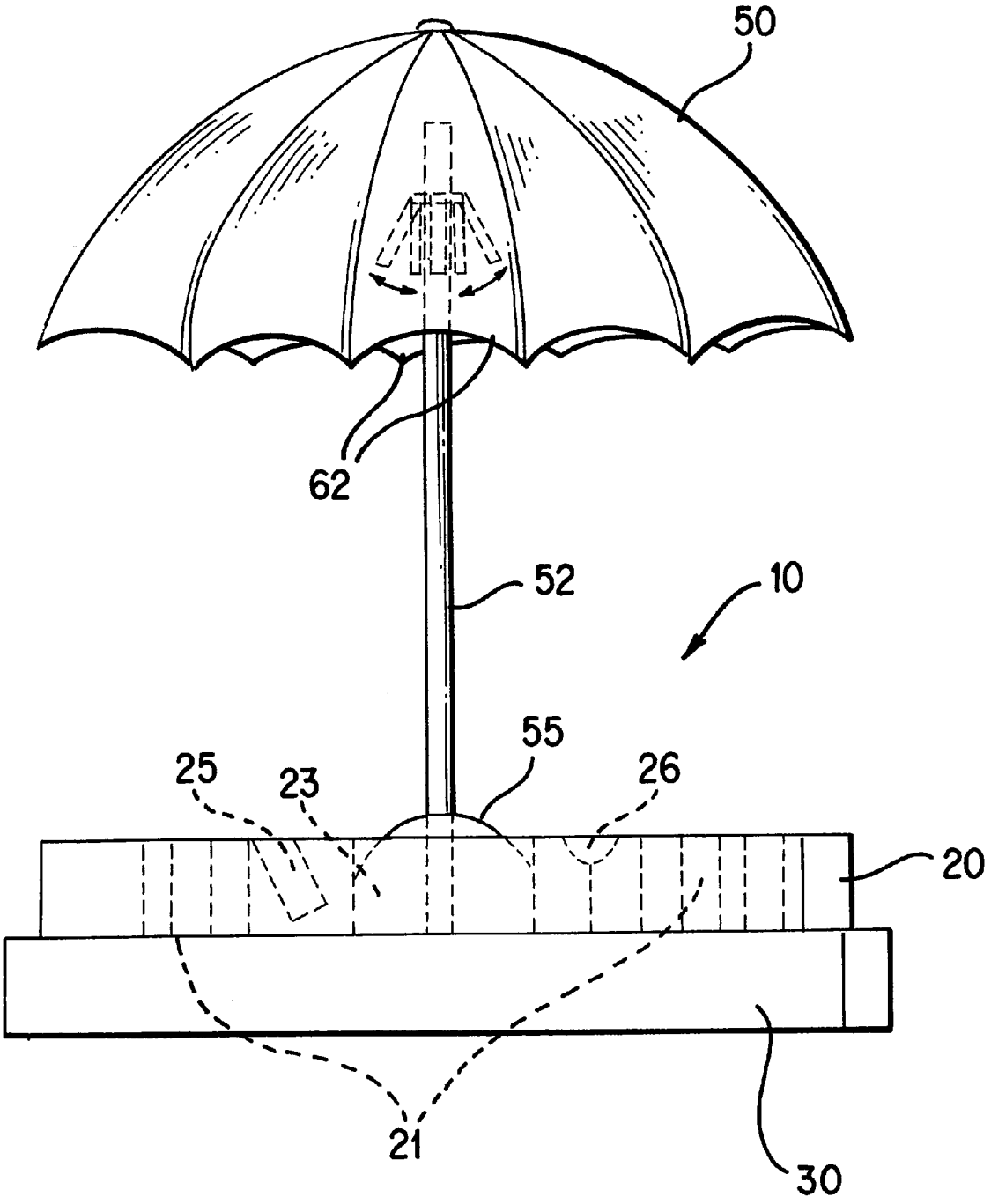
FIG. 3 illustrates a side view of the flotation unit.

With reference to the Figures, where like numerals identify the same components, the invention is further explained. As illustrated, the flotation unit 10 of the first embodiment is comprised of both an upper portion 20 and a lower portion 30. The upper portion contains a plurality of functional holding spaces, while the lower portion, as best seen in FIG. 3, is substantially solid. Through this design, the self-stability of the flotation unit is assured.

Figure 1B:
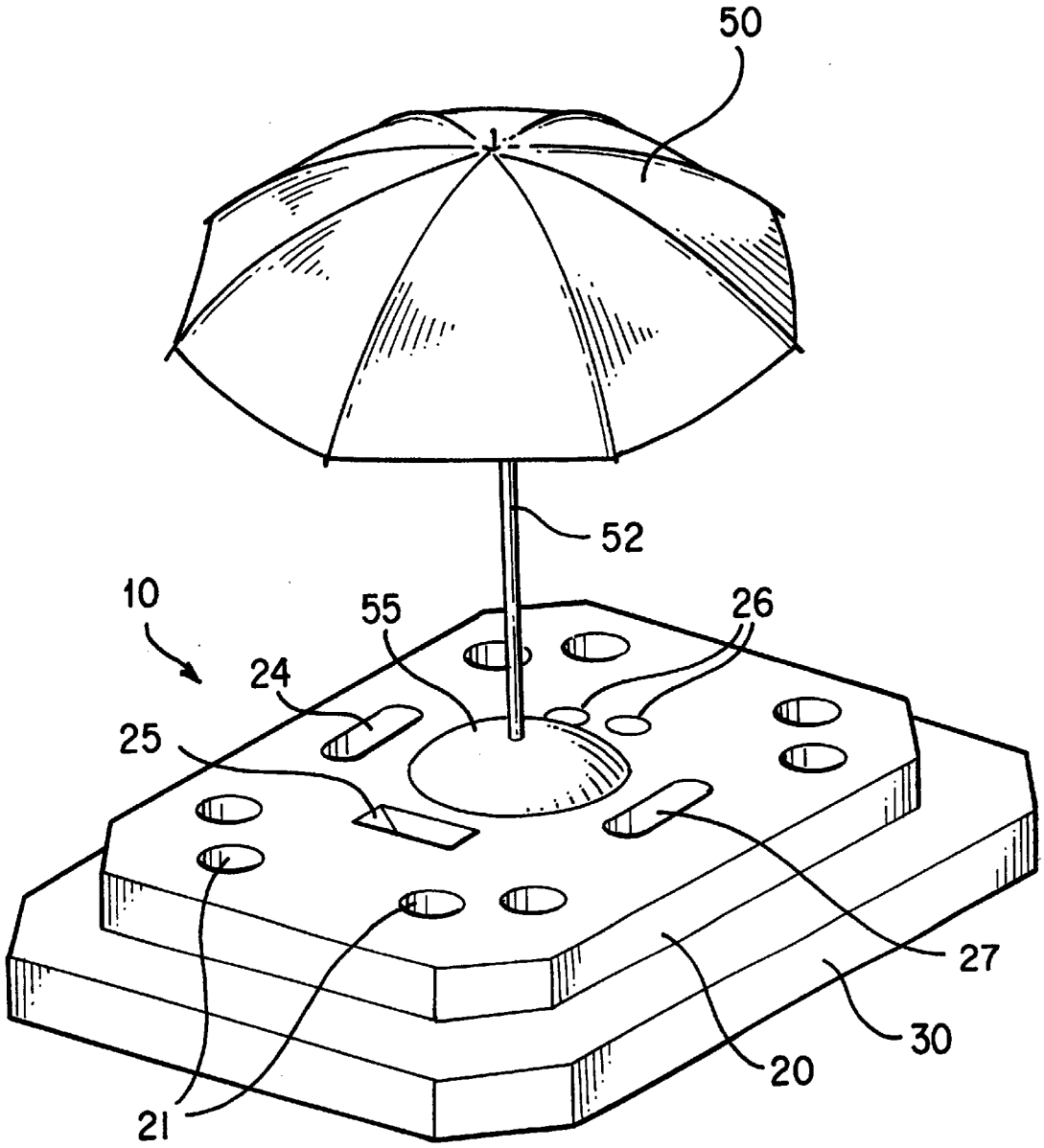
FIG. 1B illustrates an isometric view of the flotation unit of the invention with a sunshade attached.
Figure 2:
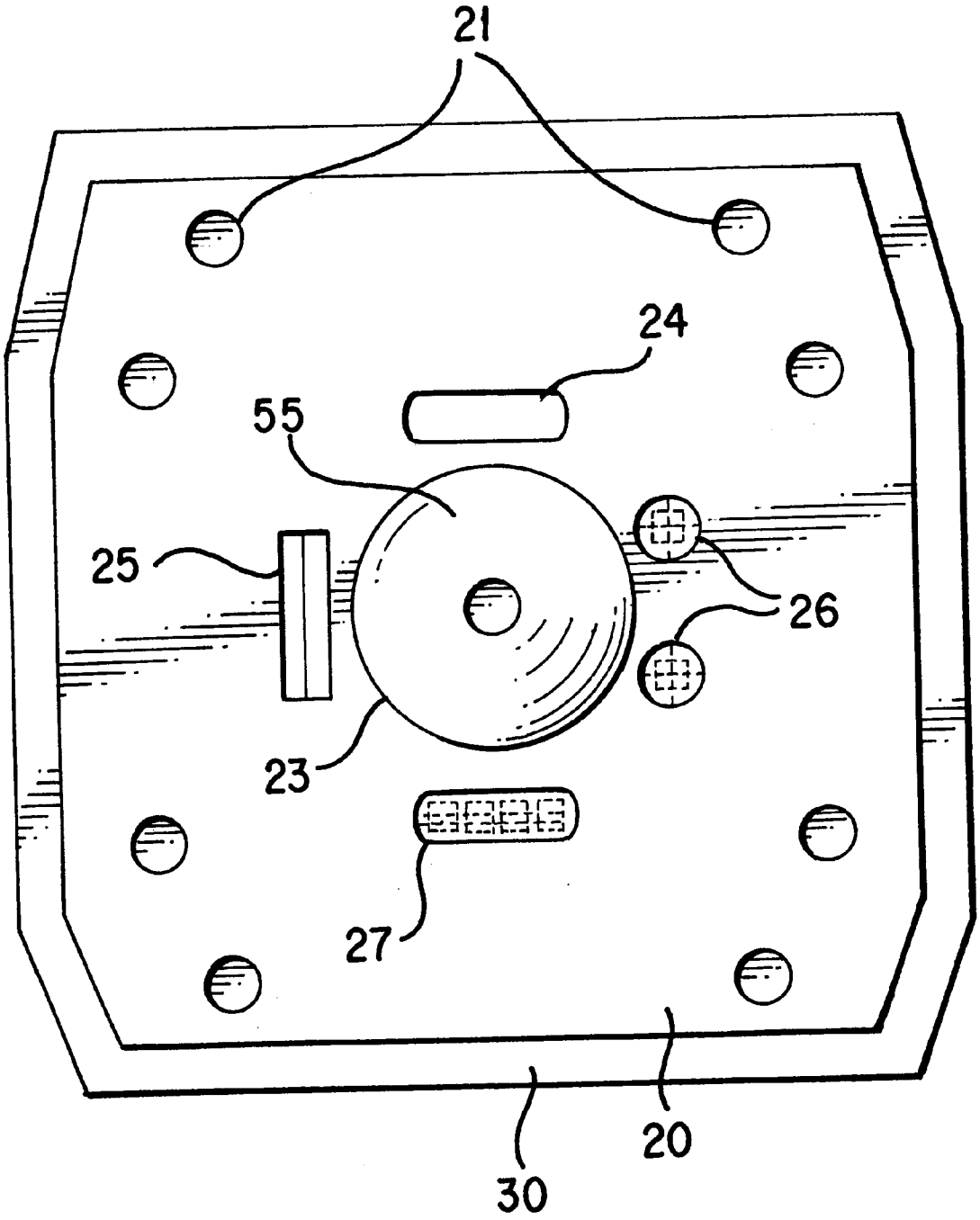
FIG. 2 illustrates a top view of the flotation unit.

As seen from FIGS. 1A and 1B, the flotation unit may be used with or without a sunshade 50, for example an umbrella. Regardless of whether or not the sunshade is present, the flotation unit remains self-stable.

As functional holding spaces contained within the upper portion of the flotation unit, any desired holding space may be formed without limitation. For example, the unit preferably includes cup or can holding spaces 21. These cup holding spaces are preferably located towards the outer periphery of the upper portion of the unit for ease in accessing the space. Any number of cup holders may be formed in the unit.

Any other holding spaces, for example as shown as 24 in the Figures, may also be used without limitation, including, for example, holding spaces for accommodating suntan lotion, hats, sunglasses, etc.

Of course, it is also desirable to keep at least some parts of the top surface of the flotation unit free of functional holding spaces so that additional "flat" storage space is available upon the surface of the unit.

In addition, it should be noted that although the surface of the unit in the Figures is illustrated as being flat, it may also preferably be formed or shaped so as to be slightly convex, the highest point being at the center of the surface of the unit and gently sloping downwards towards the periphery of the flotation unit. In this way, water that is splashed upon to the surface of the unit can drain towards the sides of the unit and back into the water.

The flotation unit also preferably includes a sunshade functional holding space 23 in the center of the top surface of the upper portion of the unit. The size of the space 23 is preferably such that it accommodates a sunshade holding unit 55, for example a standard umbrella stand or base, therein. For example, the space 23 may have a diameter of 16 inches. The unit 55 may be permanently affixed into the unit 10, for example through bonding with an adhesive or molding the flotation unit around the unit 55, it may be removably attached to the flotation unit, for example through the use of a suitable clip-in arrangement, or it may simply be placed within the space 23 without additional securement.

As seen in FIG. 1B, a pole 52 attached to the sunshade 50 is placed into an opening in the sunshade holding unit 55 in order to attach the sunshade to the holding unit. The pole should be readily detachable from the holding unit, and thus may either be placed within the holding unit or removably attached thereto by any suitable means, including clip-in devices. For ease in transporting the flotation unit, the pole should not be affixed to the holding unit through the use of screws or bolts that are very time consuming to remove.

The flotation unit may also optionally contain functional holding spaces that accommodate electronic equipment, including, for example, a radio, stereo, compact disc video and/or speaker device, as well as spaces to accommodate batteries for running the electronic equipment. For example, the unit may include a space 25 for the electronic equipment, a space 26 for speakers, and a space 27 for a power source such as batteries. Any electrical wiring connections required between the various components should preferably be waterproof. Passages for the wiring may be provided within the upper or lower portions of the flotation unit so that the wiring is within the unit and not exposed.

The flotation unit may also include, if desired, hooks on the side of the unit or on the edge of the top surface of the unit for tying the unit down with ropes or lines. Such hooks, if present, can either be integrally formed with the unit or physically attached to the unit, for example with an adhesive or any other physical type of attachment, including screwing the hooks into the unit, etc.

In another optional embodiment, the sunshade may include lights therein that are electrically connected to a power source, for example the batteries in the battery housing space 27. The lights may be removably clamped to the inside of the canopy 62 of the sunshade. The lights may be turned on and off by the electronic equipment 25 or any other means that could be accessed on the flotation unit.

The flotation unit according to the first embodiment may be made by any suitable shaping process. For moldable materials, the unit may be formed by any suitable known molding technique. The molded unit may be one piece or multiple pieces adhered together, as desired. The flotation unit also may be cut from solid sheets of material that are capable of being readily cut. For example, the preferred Ethafoam material is preferably obtained in sheet form and the unit formed therefrom by cutting the sheet to the desired shape and size, including cutting the functional holding spaces in the unit. Here again, the Ethafoam may be used to form a one piece unit, or separate sheets may be used and adhered together to form the unit. If separate sheets are used, the separate sheets should preferably have substantially the same thickness.

In a most preferred embodiment, the flotation unit is formed by cutting a first sheet of Ethafoam to form the upper portion 20 of the unit, including cutting therein the desired functional holding spaces. The lower portion 30 of the unit is then formed from a separate sheet of Ethafoam. This sheet for the lower portion is substantially solid, although it may contain therein drainage passages to lead water away from certain of the functional holding spaces, for example the cup holding spaces, or it may contain passages for any electrical wiring connections within the flotation unit.

As shown in the Figures, the upper portion preferably has a length and width shorter in both dimensions than the lower portion in order to create a low ledge that can be easily grasped and/or leaned upon by a swimmer. However, the presence of this ledge is not required.

When separate sheets are used to form the upper and lower portions of the flotation unit, the sheets are attached to one another in any suitable manner. Most preferably, the two sheets are adhered to one another using a waterproof and water resistant adhesive, for example a silicone adhesive.

In the second embodiment, the flotation unit is hollow and formed by any suitable plastic shaping process, including, for example, injection blow molding and the like. In this alternative embodiment, the air entrained by the hollow unit acts to provide the stability to the unit. Care must be taken in forming the unit to ensure that the unit is impermeable to water. Thus, the unit must be checked for holes, etc. that might be created during the formation process.

In this second embodiment, the unit may be formed to have upper portions and lower portions as discussed above, the only difference being that the lower portion in the second embodiment is hollow. Preferably, however, the hollow unit is shaped such that the holding spaces for accommodating cups therein extend down to either contact the lower surface of the unit or to near the lower surface of the unit so as to minimize the height of the unit and thereby minimize the weight of the unit. The holding spaces are indentations in the material forming the unit so as to remain impermeable to water. Solid drains may be provided from the bottom of the holding spaces out to the exterior of the lower surface of the unit to avoid water retention within the holding spaces, for example such as may be caused by splashing of water.

The holding spaces preferably extend down through the interior of the unit so as to contact or nearly contact the lower surface of the unit. By "nearly contact" is meant that the bottom of the holding spaces comes close to contacting the lower surface of the unit, leaving only minimal space, for example between greater than 0 and 2 inches, between the bottom of the holding space and the lower surface of the unit. The width and length dimensions of the unit are otherwise identical to the first embodiment described above.

All other features of the first embodiment described above are equally applicable to the second embodiment, and are thus not repeated here.

The flotation unit provided by the present invention is self-stable and lightweight, and thus provides a safe and convenient storage table/sunshade in a swimming pool. By virtue of its light weight and the easy assembly of the sunshade attachment, the flotation unit can be easily transported to different swimming pools without difficulty.

What is claimed is:

1. A flotation unit comprised of an upper portion having more than one holding space therein and a lower portion that is substantially solid; wherein the more than one holding spaces are located anywhere across a top surface of the flotation unit, wherein both the upper portion and the lower portion are comprised of a resilient foam and wherein the flotation unit has a sufficient size and weight to be self-stable, wherein the upper portion and lower portion are distinct such that a substantially flat ledge comprising a part of the lower portion than extends beyond the length or width of the upper portion is present, wherein lower portion has a bottom surface and said bottom surface is substantially flat, wherein the lower portion has a buoyancy capable of supporting greater than the weight of lower and upper portions combined; and, wherein the more than one holding space are voids in the upper portion.

2. The flotation unit according to claim 1, wherein the flotation unit has no external stabilization.

3. The flotation unit according to claim 1, wherein the flotation unit is one piece.

4. The flotation unit according to claim 1, wherein the upper portion and lower portion are separate pieces adhered together with an adhesive.

5. The flotation unit according to claim 4, wherein the adhesive is a silicone adhesive.

6. The flotation unit according to claim 1, wherein the resilient foam is comprised of a lightweight, dense polyethylene foam.

7. The flotation unit according to claim 1, wherein a top surface of the flotation unit is flat or slopes downwards towards a periphery of the flotation unit.

8. The flotation unit according to claim 1, wherein the more than one holding space include holding spaces that accommodate cups therein.

9. The flotation unit according to claim 1, wherein the more than one holding space include a holding space at a center of an upper surface of the upper portion, which holding space accommodates therein a sunshade holding unit.

10. The flotation unit according to claim 9, wherein the sunshade holding unit includes an opening to accommodate a pole of a sunshade.

11. The flotation unit according to claim 10, wherein the sunshade includes lights therein that are electrically connected to a power source.

12. The flotation unit according to claim 1, wherein the more than one holding space include holding spaces that accommodate electronic equipment therein.

13. The flotation unit according to claim 12, wherein the electronic equipment is electrically connected to a power source through wiring in passages within the flotation unit.

14. The flotation unit according to claim 1, wherein the upper portion has a length that is less than a length of the lower portion, and the upper portion has a width that is less than width of the lower portion.

15. The flotation unit according to claim 1, wherein the sufficient size of the flotation unit is such that the flotation unit remains self-stable regardless of a total weight placed upon the flotation unit, and wherein the sufficient weight of the flotation unit is such that the flotation unit is light enough to be carried by one individual.

16. The flotation unit according to claim 1, wherein the resilient foam is comprised of thin layers of foam adhered together.

17. The flotation unit according to claim 1, wherein the flotation unit includes within the upper portion as one of the one or more holding space a holding space at the center of an upper surface of the upper portion, which holding space accommodates therein a sunshade holding unit from which a pole having a sunshade thereon extends.

* * * * *